United States Patent [19]

Fletcher et al.

[11] 4,070,574

[45] Jan. 24, 1978

[54] MAGNIFYING IMAGE INTENSIFIER

[76] Inventors: James C. Fletcher, Administrator of the National Aeronautics and Space Administration, with respect to an invention of James Vine, Pittsburgh, Pa.

[21] Appl. No.: 680,958

[22] Filed: Apr. 28, 1976

[51] Int. Cl.[2] ..... H01J 31/50; H01J 39/12

[52] U.S. Cl. ..... 250/213 VT; 313/94; 313/442

[58] Field of Search ..... 313/429, 430, 442, 102, 313/94; 250/213 VT

[56] References Cited

U.S. PATENT DOCUMENTS

| | | | |
|---|---|---|---|
| 2,727,182 | 12/1955 | Francken | 250/213 TV X |
| 2,917,645 | 12/1959 | Fries | 250/213 VT X |
| 2,950,405 | 8/1960 | Poole | 313/102 |
| 3,286,114 | 11/1966 | Schlesinger | 250/213 VT |
| 3,801,849 | 4/1974 | Edgecumbe | 313/102 |

*Primary Examiner*—Saxfield Chatmon, Jr.
*Attorney, Agent, or Firm*—John O. Tresansky; Robert D. Marchant; John R. Manning

[57] ABSTRACT

An improvement in a magnetically focused image intensifier for increasing the usable range of magnification without degradation of image quality and while keeping to a minimum the power requirements of the focusing coils. The improvement comprises an arrangement of focusing coils which reverses the direction of the axial magnetic field distribution between the planes of the photocathode and the phosphor screen.

10 Claims, 3 Drawing Figures

FIG. 1
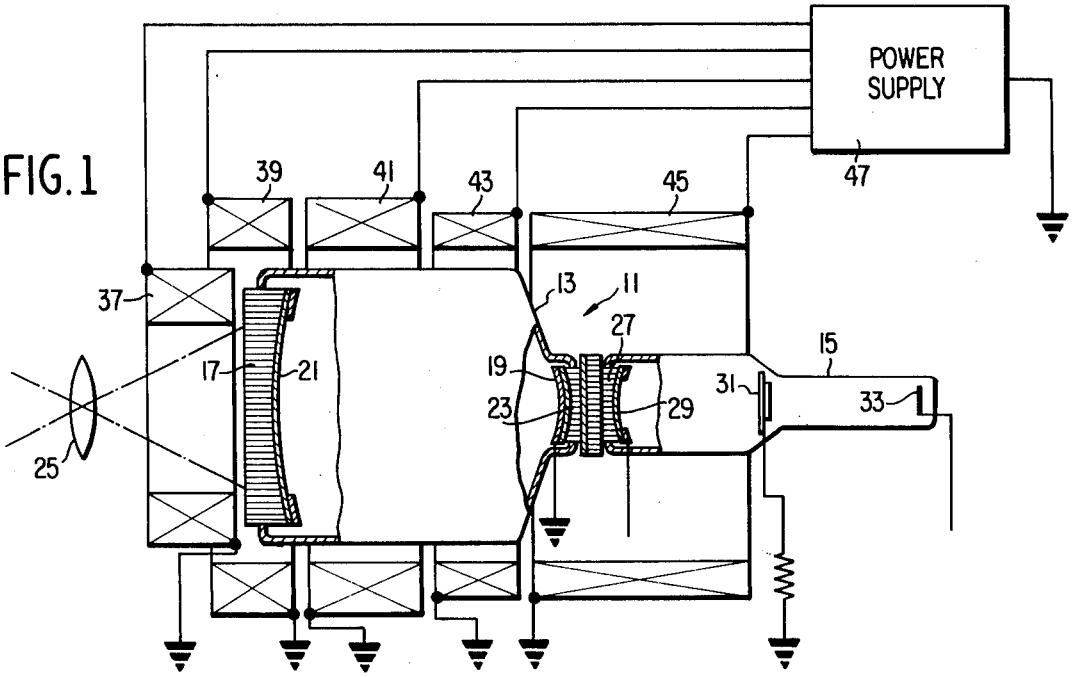
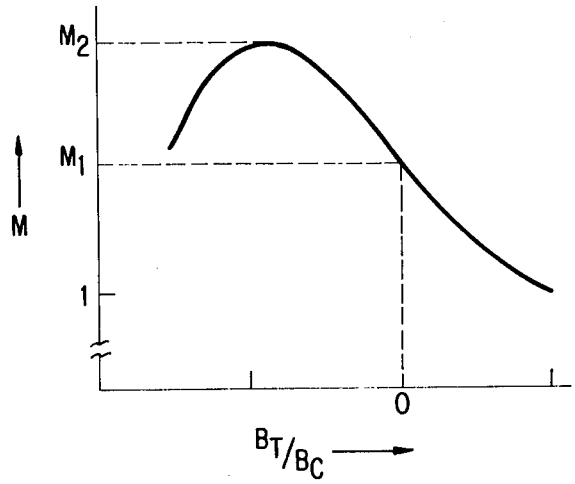
FIG. 2
FIG. 3
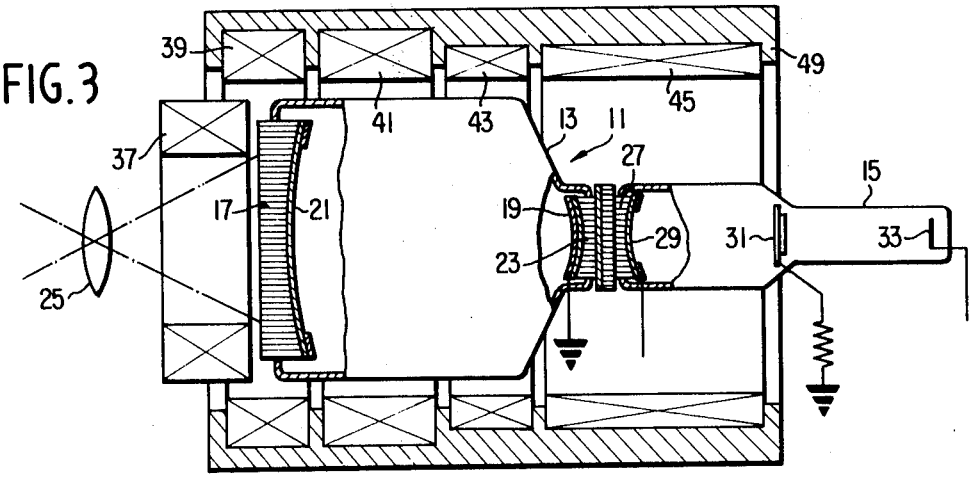

MAGNIFYING IMAGE INTENSIFIER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

1. Field of the Invention

The present invention relates generally to image tubes and more particularly to magnetically focused image tubes.

2. Description of the Prior Art

There are many applications of image intensifier tubes for sensing and amplifying, or intensifying, light images of low intensity. In these devices, light from an associated optical system is directed onto a photocathode which emits a distribution of photoelectrons in response to the input radiation. A high potential electric field, E, is provided to accelerate the photoelectrons. A coil system external to the image intensifier provides a magnetic field, B, with lines of force parallel to the longitudinal axis of the photoelectron beam, which serves as an electron lens to focus the emitted photoelectrons onto a phosphor screen. As the photoelectrons strike the phosphor screen, kinetic energy is transformed into radiant energy which is coupled to the photocathode of an associated camera tube by fiber optics. the output image of the intensifier is inverted at the face of the camera tube. The camera tube again inverts the image on the face of its target.

The most commonly used mode of operation of magnetically focused image intensifier tubes is with an imaging ratio of 1:1 (unit magnification), where it is fairly easy to obtain a good uniform image quality. However, applications arise in which it is advantageous if a tube can be made to magnify the image by some factor, thus easing design problems in the associated optical system. Alternatively the tube may be required to zoom the image, i.e. be capable of electronically varying the magnification factor, providing a greater degree of flexibility in the operation of the overall system. The magnification factors involved in these applications may be greater or less than unity.

In the unit magnification situation, both the electric and magnetic fields, E and B, are made nominally uniform throughout the active region of the tube. The main controlling factor in achieving magnification values other than unity is the magnetic field distribution. Basically, if the magnetic field decreases in strength from photocathode to screen, then the magnification factor becomes greater than one, while if the field strength increases from photocathode to screen, then the magnification factor becomes less than one. These field nonuniformities always result in degradation of image quality (resolution loss at the edge of the image, rotational and linear distortion), and this degradation limits the extremes of magnification that can be utilized in practice.

BRIEF SUMMARY OF THE INVENTION

It is therefore one object of the present invention to provide an improvement in a magnetically focused image tube for increasing the magnification factor of the image without degradation of image quality.

It is another object of the present invention to provide such an improvement while keeping the focusing coil power consumption to a minimum.

The objects of the present invention are achieved in one embodiment by the combination, in an image tube including a photocathode responsive to input light radiation for emitting an electron beam and phosphorescent means for electrostatically attracting the electron beam, of means for providing a magnetic focusing field with lines of force symmetrical about the longitudinal axis of the electron beam wherein the direction of the axial magnetic field component between the location of the photocathode and the location of the electron beam attracting means is reversed. The magnetic field providing means comprises a plurality of current conducting coils disposed about the photocathode and about the electron beam attracting means, and means for passing current in opposite directions through the coils about the photocathode and about the electron beam attracting means respectively. In a modified embodiment of the invention, a ferromagnetic housing serves as a magnetic shield for the coils so that a constricted magnetic field is set up only within the image tube.

The foregoing as well as other objects, features and advantages of the present invention will become more apparent from the following detailed description taken in conjunction with the appended drawings.

BRIEF DESCRIPTION OF THE DRAWINGS

FIG. 1 is a schematic diagram of an embodiment of an image intensifier tube and an associate camera tube in accordance with the teachings of this invention.

FIG. 2 is a graphical pesentation of the magnification versus the ratio of the screen and photocathode magnetic field strengths in the case of a linear axial field distribution.

FIG. 3 is a schematic diagram of a modified embodiment of an image intensifier tube and an associated camera tube in accordance with the teachings of this invention.

DESCRIPTION OF THE PREFERRED EMBODIMENTS

Referring to FIG. 1 of the drawings, the invention is illustrated as incorporating an image tube indicated generally by the reference numeral 11. The image tube is shown comprised of an image intensifier 13 and a pickup tube 15.

The image intensifier 13 is a vacuum tube having a tubular glass envelope which is closed at its ends by fiber optic windows 17 and 19, respectively carrying a photocathode 21 responsive to light radiation and a phosphor screen 23; in operation the photocathode is operated at a high negative potential and the screen is operated at ground potential. The light radiation collected from a scene being viewed through an optical lens 25 is imaged on the fiber optic window 17 and transferred by the fibers to the photocathode 21 were photoelectrons are released in direct proportion to the light intensity at each point of the image. The resultant electron beam emitted by the photocathode 21 is electrostatically accelerated and directed onto the phosphor screen 23 to give an intensified light image corresponding to the optical image received by the photocathode.

The light output from the image intensifier 13 is coupled to the camera tube 15. The camera tube 15 can be of the secondary electron conduction (SEC) type and includes an input fiber optic window 27 having a photocathode 29 provided on the inner surface. The photocathode is operated at a negative potential and the electron image emitted from the photocathode is focused onto a storage target 31 operating at substantially ground potential to provide a charge image. The charge image can be read out by means of an electron gun 33 illustrated as a cathode. An output signal is derived from the target 31 in response to readout by scanning the electron beam from the gun 33 over the target and this output signal can be connected to a suitable display device.

The image tube 11 is shown disposed coaxially within a multiple current conducting coil system comprising the five focusing coils 37, 39, 41, 43 and 45. Direct current flowing through the coils provides a strong axial magnetic field, B, which serves as an electron lens for the image intensifier tube 13 to focus the electrons emitted by the photocathode 21 onto the phosphor screen 23. The coils are normally connected to variable current sources in a power supply 47 so that the magnification of the image intensifier 13 can be varied in a manner analagous to a zoom lens. In operation, current is passed in opposite directions through the coils 37 and 39 about the photocathode 21 and the coils 41, 43 and 45 about the screen 23 respectively. This has the effect of providing a magnetic focusing field with lines of force symmetrical about the longitudinal axis of the electron beam wherein the direction of the axial magnetic field component is reversed between the plane of the photocathode and the plane of the phosphor screen. That is, there results a positive value for the magnetic field strength $B_c$ at the photocathode and a negative value for the magnetic field strength $B_t$ at the screen. The current values are preferably chosen so that the magnetic field distribution in the image intensifier 13 will blend smoothly into the uniform negative magnetic focusing field in the camera tube 15 provided by the coil 45 so as to minimize coil power consumption.

FIG. 2 illustrates, for a typical magnetically focused image intensifier, the dependence of the magnification M on the ratio of the value $B_c$ of the magnetic field at the photocathode to the value $B_t$ at the screen. For the particular case in which the axial magnetic field distribution is a linear function, there will be a particular field strength $B_c$ for any given ratio $B_t/B_c$ which will provide a single-loop focus at the screen to which corresponds a particular value of the magnification M. For positive values of the ratio $B_t/B_c$ ranging from one down to zero, the magnification obtainable ranges from unity up to a value $M_1$ greater than one. However, if one of the two field values is reversed, taking the ratio $B_t/B_c$ into the negative region, the magnification can be increased yet further, to a value $M_2$. By using more complicated axial magnetic field functions, even higher values of magnification can be obtained.

Thus, reversal of the direction of the axial magnetic field between the plane of the photocathode and the plane of the phosphor screen according to the teachings of the present invention enables the usable magnification range of a magnetically focused image intensifier to be extended. Further, experiment shows that the image quality at a large magnification ratio made possible by the present invention does not differ substantially from that obtained in the unit magnification case.

In a modified embodiment illustrated in FIG. 3, a ferromagnetic housing 49 surrounds the coils. The ferromagnetic housing magnetically shields the coils from one another, resulting in a constricted magnetic field being set up only within the image intensifier. This permits improved coil efficiency and greater magnetic field strengths at the photocathode with attendant high magnification values.

Obviously, numerous additional modifications and variations of the present invention are possible in light of the above teachings. It is therefore to be understood that within the scope of the appended Claims, the invention may be practiced otherwise than as specifically described herein.

What is claimed as new and desired to be secured by letters patent of the Unites States is:

1. A magnetically focused image intensifier tube, comprising:

photocathode means responsive to light radiation for emitting an electron beam;

phosphorescent means axially spaced from said photocathode means for attracting said electron beam;

first coil means surrounding said photocathode means and having an electrical current flowing therethrough in one direction, said first coil means providing a magnetic focusing field having a positive magnetic field strength at said photocathode means; and second coil means surrounding substantially all of said space between said photocathode means and said phosphorescent means and having said electrical current flowing therethrough opposite to said one direction, said second coil means providing a magnetic focusing field reversed from said magnetic focusing field of said first coil means between said photocathode means and said phosphorescent means and providing a negative magnetic field strength at said phosphorescent means for increasing the usable magnification range of said image intensifier tube without increasing the power consumption of said first and second coil means.

2. The image intensifier tube of claim 1 further including: means for magnetically shielding said first and second cil means.

3. The image intensifier tube of claim 2 wherein said shielding means is a ferromagnetic housing surrounding said first and second coil means so that a constricted magnetic field is set up only within said image intensifier tube.

4. The magnetically focused image intensifier tube of claim 1 wherein:

said magnetic focusing field of said first coil means has lines of force symmetrical about the longitudinal axis of said electron beam; and said magnetic focusing field of said second coil means has lines of force symmetrical about the longitudinal axis of said electron beam

5. The magnetically focused image intensifier tube of claim 4 wherein said first coil means further includes:

a first current conducting coil axially opposed from said photocathode means and having said electrical current flowing therethrough in said one direction; and a second current conducting coil surrounding said photocathode means and a portion of said first current conducting coil and having said electrical current flowing therethrough in said one direction.

6. The magnetically focused image intensifier tube of claim 4 wherein said second coil means includes:

a first current conducting coil axially spaced from said first coil means, surrounding a portion of said space between said photocathode means and said phosphorescent means, and having said electrical current flowing therethrough opposite to said one direction; and a second current conducting coil axially spaced from said first current conducting coil, surrounding another portion of said space and having said electrical current flowing therethrough in the same direction as said first current conducting coil.

7. The magnetically focused image intensifier tube of claim 1 furthering including secondary electron conduction pick-up tube means coupled to said phosphorescent means for providing a charge image for outputting to a display means.

8. The magnetically focused image intensifier tube of claim 7 wherein said pick-up tube means includes:

a fiber optic window coupled to said phosphorescent means for receiving an output therefrom;

a photocathode coupled to said window and operated at a negative potential for providing an electron image;

target means spaced from and axially aligned with said photocathode, said target means being at substantially ground potential for receiving said electron image and providing said charge image; and cathode means spaced from said target means for providing an electron beam to scan said target means and for producng an output signal therefrom.

9. The magnetically focused image intensifier tube of claim 8 wheren said pick-up tube means further includes a current conducting coil surrounding said phosphorescent means and a portion of said pick-up tube means between said phosphorescent means and said target means, said current conducting coil having said electrical current flowing therethrough in the same direction as said second coil means.

10. The magnetically focused image intensifier tube of claim 1 wherein said electrical current flowing through said first and second coil means is adjustable for varying the magnification of said image intensifier tube.

* * * * *